US008887996B2

(12) United States Patent
Allan et al.

(10) Patent No.: US 8,887,996 B2
(45) Date of Patent: Nov. 18, 2014

(54) SELF-SERVICE TERMINAL (SST) WITH MEDIA TRANSFER DEVICE

(75) Inventors: Douglas Allan, Perthshire (GB); Stewart James Herd, Perth & Kinross (GB)

(73) Assignee: NCR Corporation, Duluth, GA (US)

( * ) Notice: Subject to any disclaimer, the term of this patent is extended or adjusted under 35 U.S.C. 154(b) by 157 days.

(21) Appl. No.: 13/596,594

(22) Filed: Aug. 28, 2012

(65) Prior Publication Data

US 2014/0061222 A1 Mar. 6, 2014

(51) Int. Cl.
*G07D 11/00* (2006.01)
*E06B 7/32* (2006.01)

(52) U.S. Cl.
CPC ..... *G07D 11/00* (2013.01); *G07D 11/0081* (2013.01)
USPC ..... 235/379; 221/219; 109/19

(58) Field of Classification Search
CPC ..... G07D 11/0081; G07D 11/00; E06B 7/32
USPC ..... 235/379; 221/219; 109/19
See application file for complete search history.

(56) References Cited

U.S. PATENT DOCUMENTS 1,961,250 A * 6/1934 Scheeler ..... 109/19
2007/0000993 A1 * 1/2007 Graef et al. ..... 235/379

* cited by examiner

*Primary Examiner* — Thien T Mai
*Assistant Examiner* — Toan Ly
(74) *Attorney, Agent, or Firm* — Joseph P. Merhle

(57) ABSTRACT

A Self-Service Terminal (SST) and a method of selectively dispensing or depositing items of media are disclosed. The SST includes a fascia panel comprising a panel portion having a circular arc-shaped cross-section and at least one panel aperture. The SST also includes at least one media transfer device comprising an outer body portion having a circular arc-shaped cross-section, proximate to and spaced apart from the panel portion, and at least one body aperture. The body portion is rotatable with respect to the curved panel portion to selectively reveal the body aperture through the panel aperture.

8 Claims, 7 Drawing Sheets

SELF-SERVICE TERMINAL (SST) WITH MEDIA TRANSFER DEVICE

FIELD OF THE INVENTION

The present invention relates to a Self-Service Terminal (SST) and a method of securely operating such a terminal. In particular, but not exclusively, the present invention relates to a self-service terminal such as an Automated Teller Machine (ATM) which has a fascia panel having a circular arc-shaped cross-section and a panel aperture and a media transfer device including an outer body portion having a circular arc-shaped cross-section and an aperture. The body portion is rotatable with respect to the curved panel to selectively reveal the aperture of the body portion through the aperture in the outer fascia panel.

Various Self-Service Terminals (SSTs) are known. Such SSTs may, for example, be renewal terminals, ticketing terminals, ATMs, banking kiosks, lottery ticket terminals or the like. In each such terminal security is a key concern as the terminals are often used to store or deposit valuable items of media such as currency notes, checks, pre-payment cards, scratch cards, blank templates or other sheet-like media.

For example, a typical ATM dispenser mechanism can be exposed to fraudulent attack by having an open cash tray or easy to overcome shutter mechanism. Prior known shutter mechanisms provide little security against explosive attacks and limited security against other such forms of tampering. Likewise, some ATMs are prone to intrusion if a concerted effort to access the ATM is permitted for a prolonged period of time.

SUMMARY OF THE INVENTION

It is an aim of the present invention to at least partly mitigate the above-mentioned problems.

It is an aim of certain embodiments of the present invention to provide a Self-Service Terminal (SST) with access to an aperture through which currency notes or checks are accessible being prevented when the SST is not in use, or when intrusion/tampering is detected.

It is an aim of certain embodiments of the present invention to provide a secure method for operating an SST such as an ATM whereby an inner tamper resistant body panel of an ATM is rotated with respect to an outer tamper resistant panel of the ATM so that items of media can be received or dispensed through aligned apertures in the tamper resistant elements.

It is an aim of certain embodiments of the present invention to provide a method of selectively dispensing or depositing items of media at a Self-Service Terminal (SST) whereby items of media can be dispensed or deposited through aligned apertures during a dispensing or deposit mode of operation with the apertures being non-aligned to thereby prevent tampering when not in an operational mode.

It is an aim of certain embodiments of the present invention to enable a spray-type media dispenser of an SST to present a neat bunch of items of media in a way typically provided by a bunch-type media dispenser.

It is an aim of certain embodiments of the present invention to provide an SST in which more than one media type can be presented together to improve simplicity of the customer interface whilst maintaining security.

It is an aim of certain embodiments of the present invention to provide a secure card reader interface to thereby prevent attachment of skimmer devices.

According to a first aspect of the present invention, there is provided a Self-Service Terminal (SST), comprising:

a fascia panel comprising a panel portion having a circular arc-shaped cross-section and at least one panel aperture; and at least one media transfer device comprising an outer body portion having a circular arc-shaped cross-section, proximate to and spaced apart from the panel portion, and at least one body aperture; wherein the body portion is rotatable with respect to the curved panel portion to selectively reveal the body aperture through the panel aperture.

Aptly, the media transfer device comprises a drum element comprising a substantially hollow cylindrical body closed at a first and further end thereof and rotatable about a respective longitudinal axis of rotation, said outer body portion comprising a region of the outer surface of the cylindrical body.

Aptly, the media transfer device comprises a card reader housing supporting a user card reader device, and a front panel secured to the housing comprising said outer body portion, said housing being rotatable about a respective axis of rotation to rotate the outer body portion therewith.

Aptly, the panel portion and said body portion are manufactured from a tamper resistant material, wherein when the body aperture of the media transfer device is not aligned with the panel aperture, a remainder region of the outer body portion closes the panel aperture to unauthorized access.

Aptly, when the at least one media transfer device comprises a plurality of media transfer devices, each media transfer device is arranged to rotate together and/or separately about a common axis of rotation, said common axis comprising a centre of an imaginary circle including the circular arc of each respective body portion.

Aptly, the transfer device further comprises a pair of opposed clamping elements supported in the cylindrical body that move apart and close together as the drum element is rotated to receive items of media therebetween when apart at least one rotation position and present items of media from therebetween when apart and aligned with said panel aperture at a further rotation position.

Aptly, the opposed clamping elements are locatable together towards said panel aperture when the drum element is at said further rotation position.

Aptly, the opposed clamping elements comprise a pair of clamp plates that are secured together at respective first ends thereof and open and close at respective further ends thereof automatically as the drum member rotates.

Aptly, the outer body portion comprises at least two further body apertures and at least item support surface wherein the two further body apertures are aligned when the drum element is at a still further rotation position to thereby provide an item pathway from said panel aperture to a pair of opposed grip rollers of the SST.

Aptly, the SST is an Automated Teller Machine (ATM) and each item of media is a currency note.

According to a second aspect of the present invention, there is provided a method of selecting dispensing or depositing at least one item of media at a Self-Service Terminal (SST), comprising the steps of:

selectively rotating at least one media transfer device comprising an outer body portion having a circular arc-shaped cross-section with respect to an SST fascia panel comprising a panel portion having a circular arc-shaped cross-section; and dispensing or depositing at least one item of media through a panel aperture in the panel portion and a body aperture in the body portion aligned with the panel portion aperture.

Aptly, the media transfer device comprises a drum element and the method further comprises one-by-one locating items of media between two open clamping elements in the drum element with the drum element at at least one rotation position; and presenting the located items of media as a bunch with the drum element at a further rotation position in which the body aperture is aligned with the panel aperture.

Aptly, the method further comprises the steps of, subsequent to or prior to the step of one-by-one locating items of media of a first media type between the clamping elements, locating a further item of media having a further new media type between open clamping elements with the drum element at a new rotation position.

Aptly, the method further comprises the steps of, subsequent to a step of presenting items of media as a bunch with the drum element at the further rotation position, rotating the drum element to a purge position and opening the clamping elements to thereby drop presented but not dispensed items of media into a purge region.

According to a third aspect of the present invention, there is provided a method of securely operating an Automated Teller Machine (ATM), comprising the steps of:

rotating an inner tamper resistant body portion of an ATM with respect to an outer tamper resistant panel portion of the ATM; and receiving or dispensing items of media via aligned apertures in the body portion and panel portion.

Certain embodiments of the present invention only expose a security sensitive media exit area when items of media are being dispensed or accepted. The media exit area remains concealed and secure whilst not in use.

Certain embodiments of the present invention may be incorporated into a security enclosure opening of an ATM and can be securely locked in place to create a physical barrier to prevent access to the inside safe. This can increase protection against gas and solid explosive attacks.

Certain embodiments of the present invention enable items of media dispensed from a spray dispenser type to be presented in a neat bunch in a manner reminiscent of more expensive bunch dispenser devices. This helps reduce overall production costs for those wishing to provide such functionality.

Certain embodiments of the present invention enable more than one media type to be presented simultaneously. For example, currency notes and a receipt may be presented together in a bunch to a user. This helps simplify a customer interface, increases security and improves overall customer experience.

Certain embodiments of the present invention can optionally be utilized to provide a secure card reader interface which thereby prevents easy attachment of skimmer devices which could otherwise pose a security risk.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
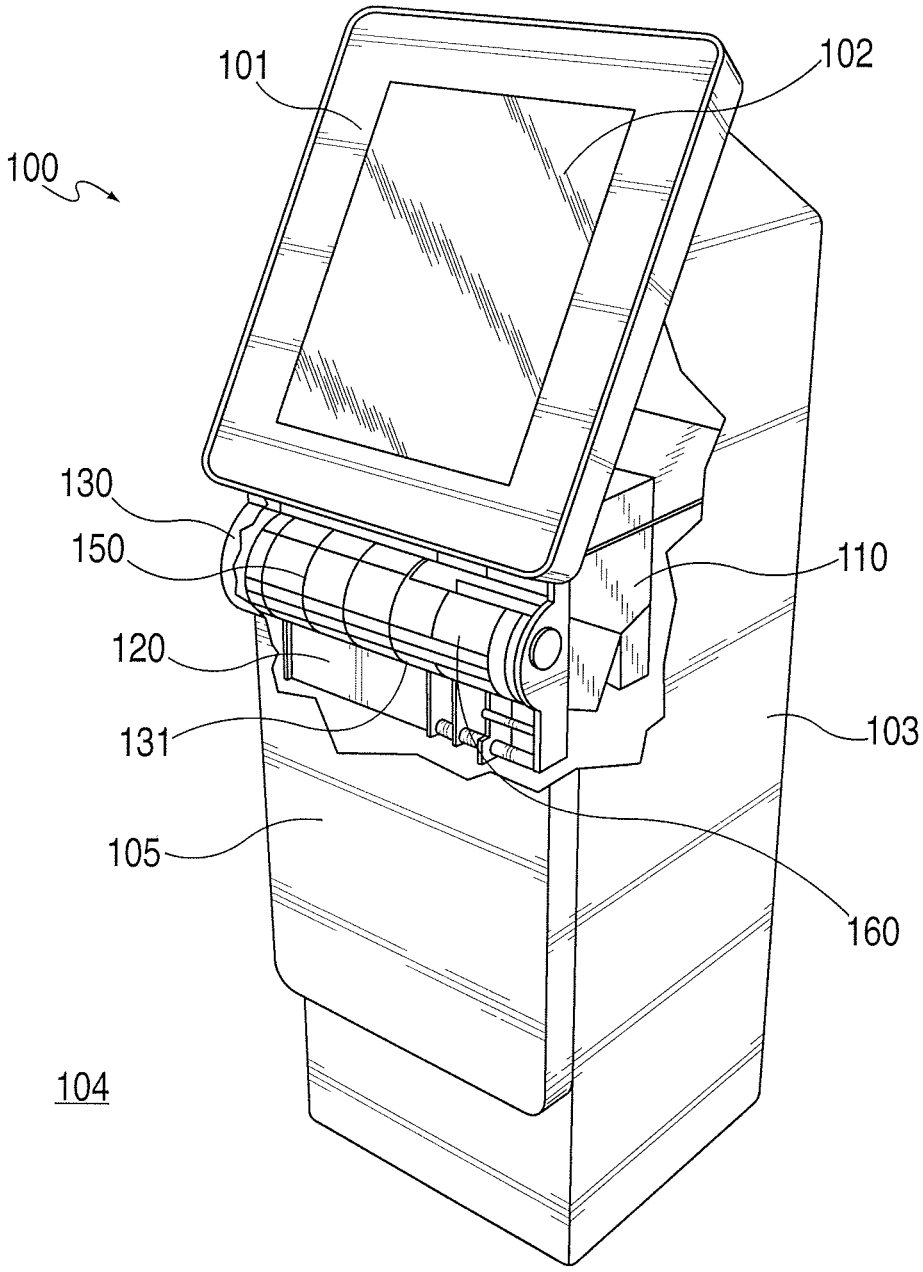
FIG. 1 illustrates an Automated Teller Machine (ATM) with a drum-like shutter mechanism according to an embodiment of the present invention.

In the drawings like reference numerals refer to like parts.

FIG. 1 illustrates a Self-Service Terminal (SST) in the form of an Automated Teller Machine (ATM) 100 according to an embodiment of the present invention. It will be appreciated that certain embodiments of the present invention are not restricted to use in an ATM but are generally more broadly applicable to SSTs of a broad variety of types. The ATM 100 includes a user interface 101 which includes a touchscreen 102. A user touches the touchscreen 102 at appropriate places to select various options displayed and thereby determine actions carried out at the terminal. The display is mounted to a secure cabinet 103 which is a stand-alone type ATM. Such a stand-alone or lobby-type ATM stands upright on a floor surface 104 and is manufactured from a rigid material such as steel or the like so as to prevent ingress into the contents of the ATM by unauthorized personnel. It will be appreciated that different types of ATM can incorporate certain embodiments of the present invention. For example, the ATM may be a hole in the wall-type ATM.

A cosmetic door 105 and other such cosmetic elements may be secured to the rigid housing 103 of the ATM 100 as will be appreciated by those skilled in the art. The ATM 100 illustrated in FIG. 1 is shown in a partially transparent mode revealing inner parts within the ATM 100 such as a card reader 110 and cash dispenser module 120. Each of these is shown more clearly hereinafter.

The ATM 100 has a front facing rigid fascia panel 130 which has a circular arc-shaped cross-section. This fascia panel 130 thus presents a substantially cylindrical outer surface 131 to a user standing in front of the ATM 100. An elongate aperture 140 extends substantially across the width of the ATM 100 in the fascia panel 130. The material the rigid fascia panel is manufactured from is selected to make it tamperproof. Rather than one single elongate aperture, multiple apertures could optionally be utilized.

The aperture 140 in the fascia panel 130 reveals two media transfer devices within the ATM 100. Each of these includes an outer body which includes at least a part that also has a circular arc-shaped cross-section. The first media transfer device 150 shown in FIG. 1 is a dispense/deposit device which is used to dispense currency notes and optionally receipts and via which currency notes and/or checks may be deposited. The second media transfer device 160 shown in FIG. 1 is a card reader device used by a user to identify themselves and authorize a transaction. It will be appreciated that SSTs according to certain embodiments of the present invention may utilize one, two, three or more transfer devices, each of which has an outer body portion which at least has a part that is circular arc-shaped in cross-section to match the cross-section of an inner surface of the circular arc-shaped cross-section of the fascia panel. The various transfer devices may be aligned in a side by side relationship and share a common curvature and axis of rotation.

Figure 2:
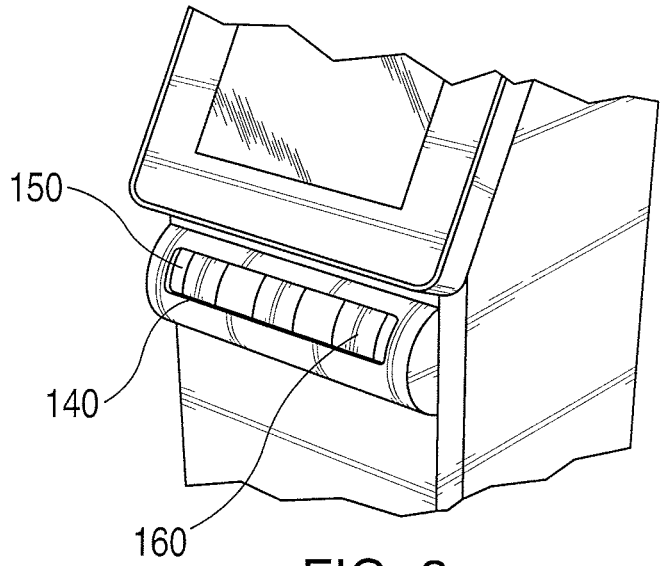
FIG. 2 illustrates the ATM in tamperproof mode.

FIG. 2 illustrates the respective body portions of the two media transfer devices visible through the aperture 140 in the fascia panel of the ATM shown in FIG. 1 in more detail. The fascia panel 130 which has a substantially cylindrical outer surface is formed of a tamper resistant material; that is to say, metal such as steel or the like, or some composite material. The rigid fascia panel 130 thus helps prevent ingress into the safe regions within the terminal 100 by unauthorized personnel. In a non-operational state shown in FIG. 2, the aperture 140 in the fascia panel 130 is effectively closed by virtue of two circular arc-shaped cross-section body parts of the two media transfer devices in the terminal 100. These thus act like a shutter closing the open mouth of the terminal 100. Each of these curved body portions are themselves formed from tamper resistant materials such as metal, such as steel or the like, or composite materials. In the state shown in FIG. 2, an almost flush and completely closed surface is presented to a user. This prevents an unauthorized user from attaching skimming devices or otherwise penetrating into the terminal 100. The media transfer devices can be locked in this position during periods of non-use and also may be selectively locked in this position if tampering is detected by one or more sensors (not shown) on the ATM 100.

Figure 3:
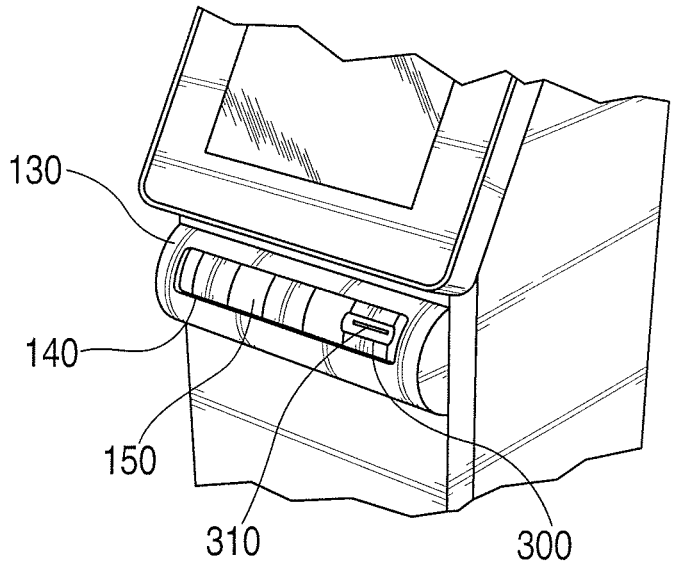
FIG. 3 illustrates an exposed card reader slot.

FIG. 3 illustrates the ATM 100 in a state subsequent to the closed and protected "home" state shown in FIG. 2. When a user presents themselves at the terminal they may proceed with an onscreen activation step by interacting with the touchscreen of the user interface (or by pressing one or more buttons, etc). A customer makes a selection to open access to a card reader and this causes a card reader transfer device 160 within the terminal 100 to rotate within the arc-shaped fascia panel 130 through a pre-determined angle. This causes an aperture 300 in a curved outer body panel of the card reader transfer device 160 to be rotated into view through the principal aperture 140 in the fascia panel 130. This is shown in FIG. 3. The aperture 300 reveals a card reader slot 310 through which a user may introduce an identification card into the terminal 100, as will be appreciated by those skilled in the art. By having this card reader slot 310 and aperture 300 rotated out of the way and protected by a remainder region (a non-aperture region) of the fascia panel 130 when not in use, unauthorized access to the card reader and slot are thereby avoided.

Figure 4:
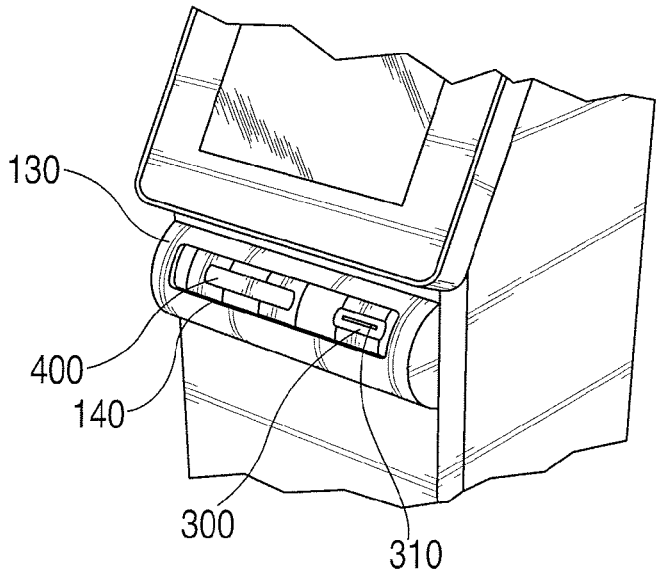
FIG. 4 illustrates an exposed card reader slot and an exposed deposit/dispense slot.

Once a transaction has been initiated and authorized by entry of a card into the card reader slot 310 and subsequent to a user making various selections via the user interface, the media transfer device 150 adjacent to the card reader transfer device 160 is itself rotated behind the fascia panel 130 so that an access aperture 400 is revealed. This is illustrated more clearly in FIG. 4. Only once the access aperture 400 in the body of the dispense/deposit device 150 is aligned and visible through the principal aperture 140 can a user be given access to the mechanism used in the terminal 100 to dispense (and deposit) currency notes.

Figure 5A:
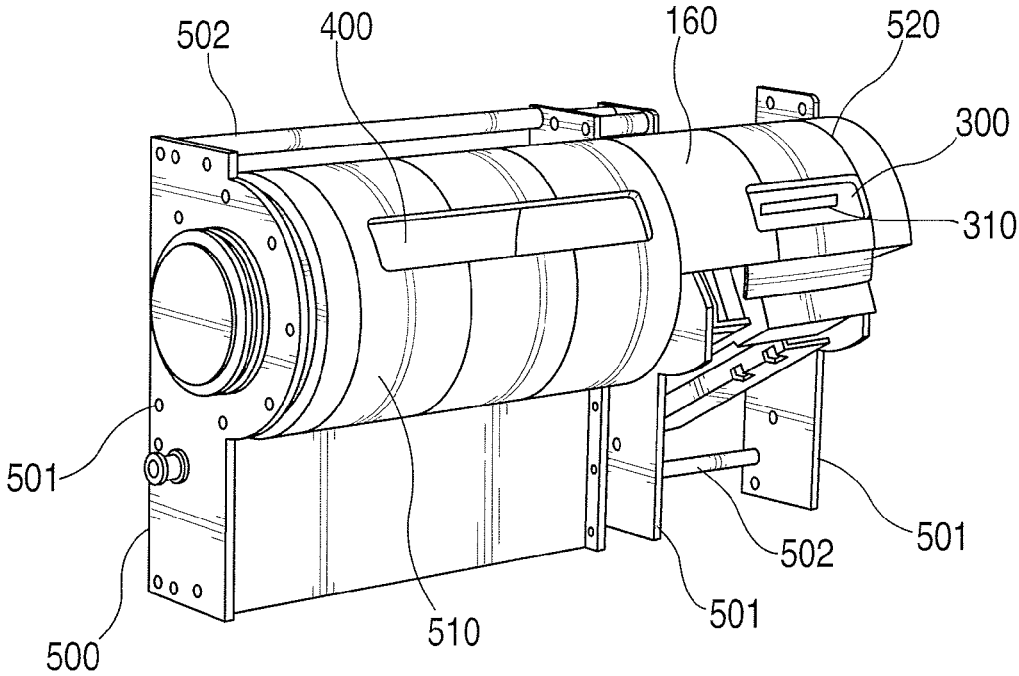
FIG. 5 illustrates possible movement and positioning of two types of media transfer device.
Figure 5B:
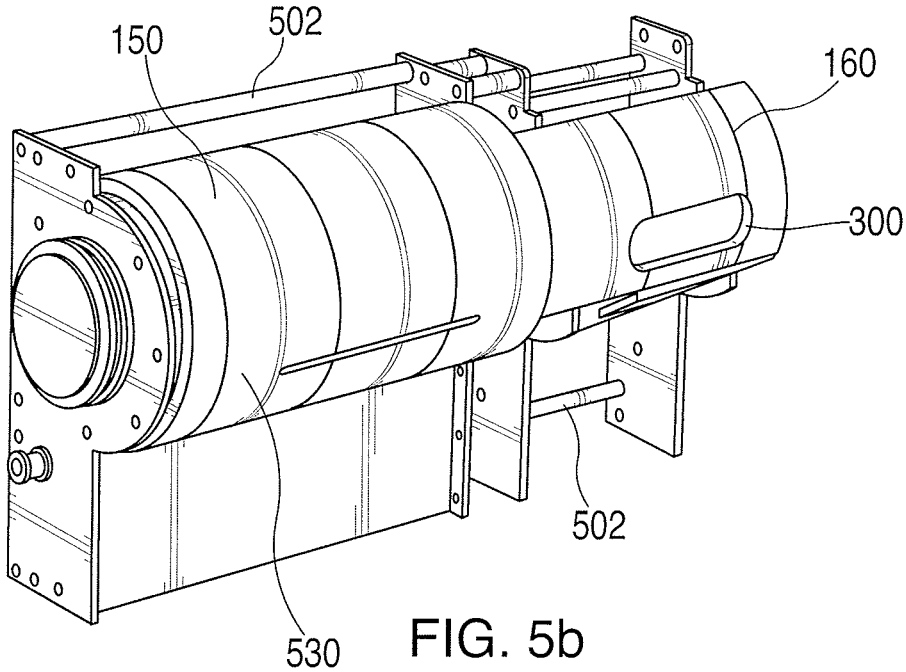
Figure 5C:
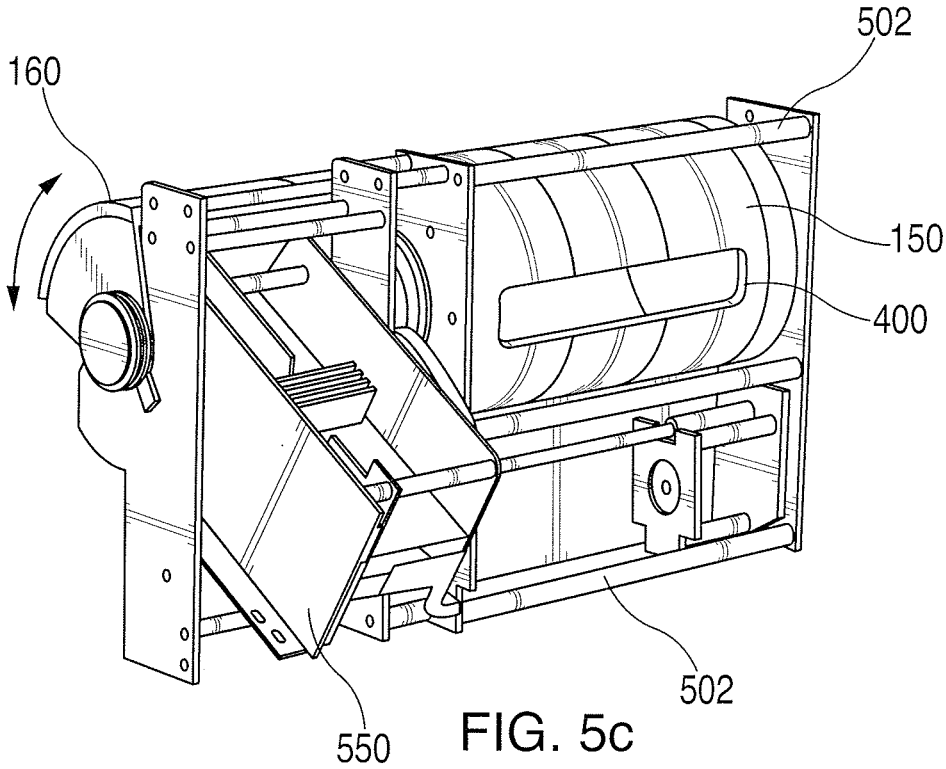

FIG. 5 illustrates the first media transfer device 150 which may be utilized to dispense or deposit currency notes and the second media transfer device 160 which is a card reader device, in more detail. More particularly, FIG. 5 illustrates the devices themselves which are movable behind the fascia panel 130 and tamperproof housing of the terminal 100. As illustrated in FIG. 5*a*, a rigid housing 500 includes spaced apart plate-like panels 501 which are secured to the chassis of the terminal 100. These are rigidly kept in a substantially parallel and spaced apart configuration by multiple cross beams 502 (best seen in FIGS. 5*b* and 5*c*). The cross beams 502 and panels 501 form a support in which a cylindrical body 510, forming the first media transfer device 150, is supported.

The cylindrical body 510 is manufactured from a tamperproof material. The cylindrical body 510 can be selectively rotated about an axis of rotation by any convenient means, such as a motor and drive belt structure (not shown). The second media transfer device 160 which is a card reader device has an arcuate body panel 520 in which the aperture 300 is located. The arcuate body panel 520 of the card reader is manufactured from a tamper proof material.

As illustrated more clearly in FIG. 5*b*, the cylindrical outer surface 530 of the cylindrical body 510 and the substantially partially cylindrical outer surface of the arcuate body panel 520 of the card reader 160 share a common radius of curvature and common centre of curvature. The body 510 of the first media transfer device 150 and the curved body panel 520 of the second media transfer device 160 may be simultaneously or independently rotated about a common (or a respective axis) of rotation.

It will be appreciated that FIG. 5*b* is a view of the media transfer devices in a tamperproof orientation. In this position, anyone looking at the principal aperture 140 on the fascia of the terminal 100 would see only tamperproof material. In FIG. 5*a*, the access aperture 400 of the first media transfer device 150 has been brought into alignment with the principle aperture 140 in the fascia panel 130 by rotating the first media device 150 about its respective axis of rotation until alignment occurs. Likewise, in FIG. 5*a* the aperture 300 in the arcuate tamperproof panel 520 of the second media transfer device 160 has been brought into alignment with the principal aperture 140 in the fascia panel 130 by rotating the card reader device 160 about a respective axis of rotation.

FIG. 5*c* illustrates a view of the first media transfer device 150 and the second media transfer device 160 from a reverse side to that shown in FIGS. 5*a* and 5*b*. That is to say, from a viewpoint from within the terminal 100. FIG. 5*c* illustrates how a remainder part of the card reader 160 is formed as a substantially rectangular housing 550 which houses the various components for receiving and verifying a user identification card through the card reader slot 310. This housing 550 moves together with the arcuate body panel 520 as the card reader 160 is rotated to either reveal the card slot or hide the card slot as appropriate.

FIG. 6 helps illustrate how rotation of the cylindrical body 510 of the first media transfer device 150 occurs to selectively receive currency notes and/or receipts and/or other such items of media and how these can then be presented as a bunch through the principal aperture 140 in the fascia. Also, if not duly picked, these can be returned to a purge bin region. In more detail, FIG. 6*a* illustrates the position of the cylindrical body 510 in the "awaiting customer" state. At this point, a user looking at the principal aperture 140 in the fascia panel of the terminal sees only a section of the outer surface of the tamperproof cylindrical body 510. The distance between the outer surface 601 of the cylindrical body and an inner surface 602 of the fascia panel is small. Aptly, the distance is one millimeter or less. Aptly, the distance is two millimeters or less. Aptly, the space between the rotating cylinder and fascia panel is between one and four millimeters. This helps prevent ingress of unauthorized material. Whilst the cylindrical body 510 is hollow, it is not empty. Rather, the body supports a first support strut 605 which extends more or less diametrically across the inside of the cylindrical body and a further support strut 608 which is supported within the cylindrical body at an angle of about around ten to thirty degrees with respect to the first support strut. Aptly, the support struts are angled with respect to one another by about around twenty five degrees. The support struts 605, 608 are fixed in place and move with the cylindrical body 510 of the first media transfer device. The support struts may be plates or multiple bars extending along the length of the cylindrical body.

A pair of pivotable plates 620, 621 are carried and supported by the respective struts 605, 608. These plates open and close like jaws automatically as the cylindrical body rotates. These plates also move towards and away from the access aperture 400 at particular points in the rotation cycle of the cylindrical body as it rotates.

Figure 6A:
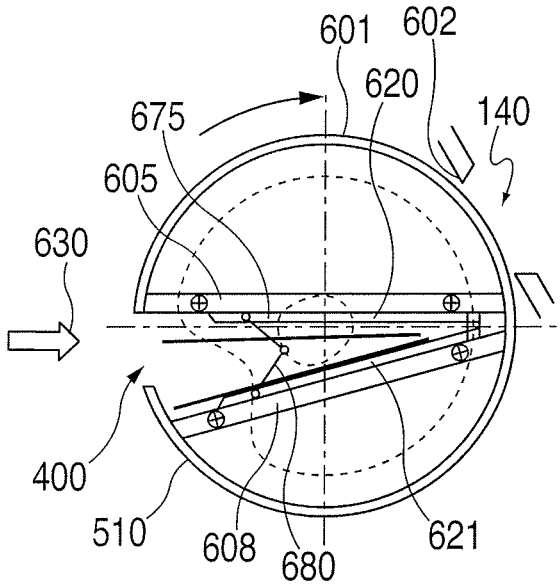
FIG. 6 illustrates rotation of a cylindrical body in a dispense mode of operation.
Figure 6B:
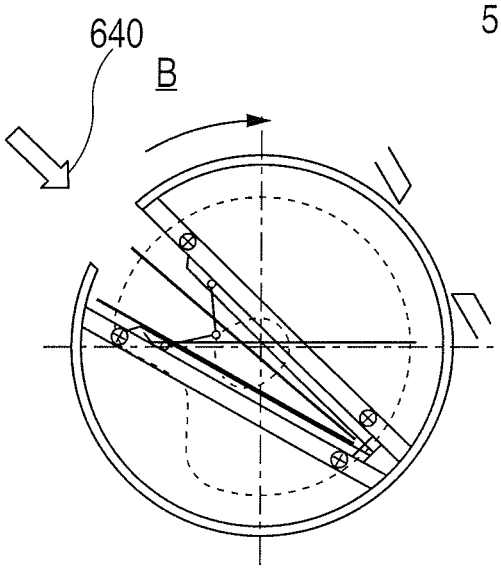

As illustrated in FIG. 6*a*, when a user is duly authorized and requests currency notes, these currency notes 630 are introduced one-by-one from within a dispensing module 120 of the terminal 100 and deposited inside the cylindrical body 510 through the access aperture 400. Because of the location of the cylindrical body in the note receiving position (in which the strut 608 is slightly declined), the notes which are introduced in a substantially horizontal direction will collect between the plates 620, 621. They do not fall out because of a lip provided by part of the wall of the cylindrical body. Once all desired notes are located in the cylinder, the cylinder is rotated in a clockwise direction shown by arrow B in FIG. 6*b*. Rotation then ceases with the access aperture 400 in the cylinder being orientated in a direction to receive a further item of media in the form of a printed receipt 640 or the like. This enables multiple media types to be collected as a single bunch for dispensation to a user.

A separate clamp slot could optionally be provided to separate currency notes from other types of media added as the cylindrical body rotates.

Subsequent to delivery of the receipt between the jaws of the plate 620, 621 the cylindrical body 510 continues to rotate in a clockwise rotation. As this occurs, the plates 620, 621 close like jaws to form collected items of media into a neat bunch. This is assisted by virtue of the fact that gravity acts in this position to help collect the items of media in a desired stack. As the cylindrical body further rotates, the plates automatically close in a pinching motion illustrated by the arrows C in FIG. 6*c*.

Figure 6C:
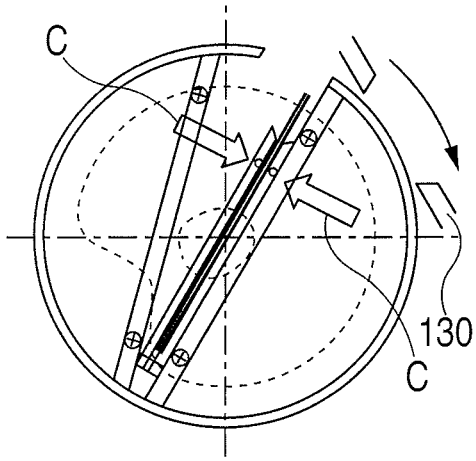
Figure 6D:
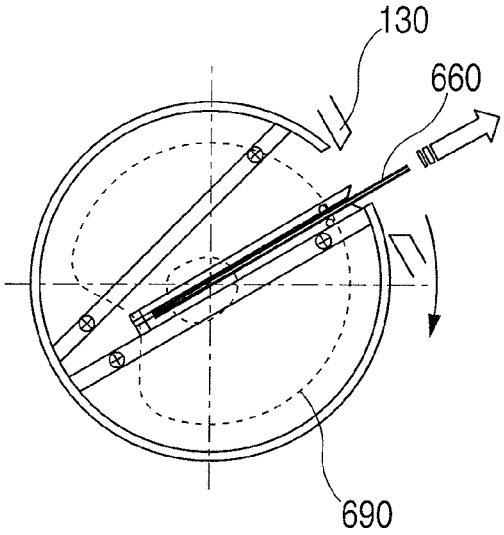

FIG. 6*d* illustrates an item of media presentation orientation in which the cylinder has been further rotated in a clockwise direction with respect to that shown in FIG. 6*c*, so that the access aperture 400 in the rotating drum is now substantially aligned with the principal aperture 140 in the fascia panel. In this position, the plates 620, 621 which are urged together in a pinching motion are further urged forwards, that is to say, radially outwardly so as to present any items of media stacked between the plates towards a user.

As the currency notes pass into the open customer slot, the groove pushes the clamped note bunch outwards to enable the customer to take the notes.

Figure 6E:
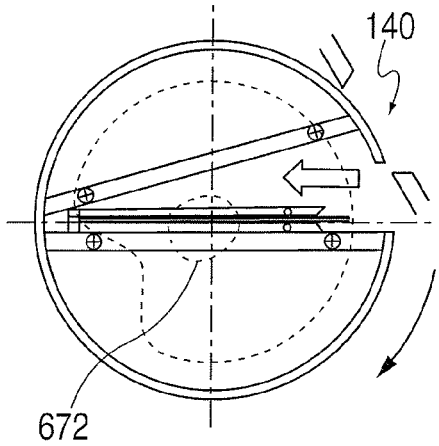

FIG. 6*e* illustrates the continued rotation of the cylindrical body subsequent to either the notes being removed by a user or (as shown in FIG. 6*e*) subsequent to a time out occurring in which case the notes are retracted if not taken. As illustrated in FIG. 6*e*, as the cylindrical body continues to rotate clockwise, the clamping plates are withdrawn which draws the stack of currency notes back within the recess of the cylindrical body.

Figure 6F:
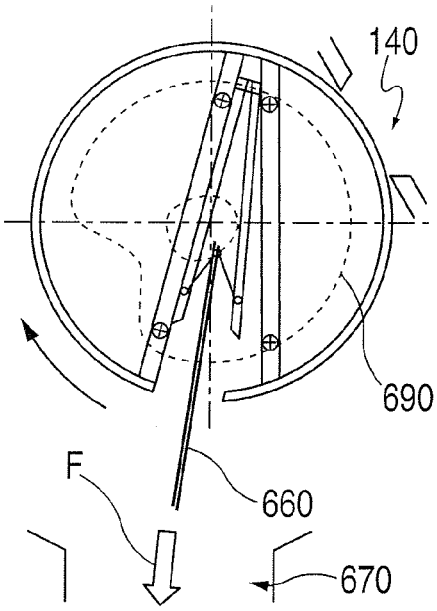

FIG. 6*f* illustrates a further position of the cylindrical body in which the cylindrical drum has rotated a further clockwise step relative to the position shown in FIG. 6*e*. In this position, the stack of currency notes which have not been duly picked are aligned almost vertically. In this position, the clamping plates are made to automatically open and the pinching force is thereby removed. Gravity causes the stack of notes 660 to be released and these fall into a purge bin region 670 in the direction shown by arrow F in FIG. 6*f*. The cylindrical body, thus now empty, is made to rotate further in a clockwise direction to return to a home position as illustrated in FIG. 6*a* ready for a next dispensation operation.

Aptly, an inner cam profile (shown as an inner dotted line) 672 and a first linkage arm 675 secured to the first plate 620 and a further linkage arm 680 secured to the further plate 621 open and close the media tray automatically as the drum rotates. Aptly, an outer cam profile 690 presents the media tray forward at the presentation point as the drum rotates. If media is not taken in by a user/customer the outer cam profile 690 also withdraws the tray.

Figure 7A:
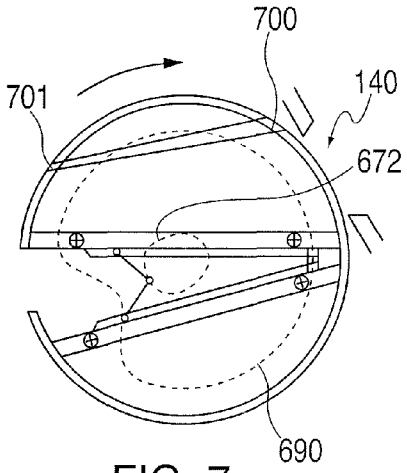
FIG. 7 illustrates rotation of a cylindrical body in a deposit mode of operation.

FIG. 7 illustrates a deposit mode of operation. More particularly, FIG. 7 illustrates how, according to certain embodiments of the present invention in which the terminal is arranged to receive deposited items of media from a user, the cylindrical body includes not just the access aperture 400 utilized during a dispensing mode of operation, but also a further deposit aperture 700 together with a co-operating input aperture 701 disposed some way away from the deposit aperture 700. As illustrated in FIG. 7*a*, the cylindrical body 510 is held in a "home" position waiting for user instructions. When a user, via the user interface of the terminal, indicates that a deposit is to be made, the cylindrical drum is rotated clockwise from the position shown in FIG. 7*a*. It is to be noted that as shown in FIG. 7*a* in the "home" position a user of the ATM viewing the principal aperture 140 in the fascia sees only the tamperproof material of the cylindrical drum.

Figure 7B:
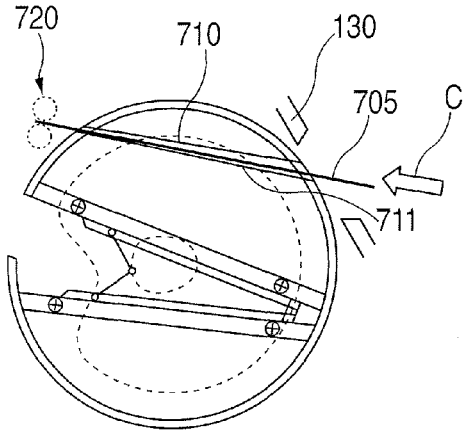
Figure 7C:
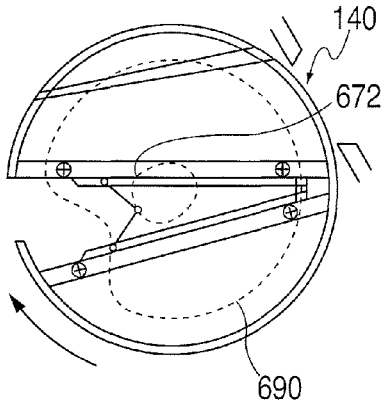

As the cylindrical body rotates clockwise, the position shown in FIG. 7*b* is reached. In this position, the deposit aperture 700 is revealed through the principal aperture 140 of the fascia. A user can then deposit one or more items of media 705 by locating these along the direction shown by arrow G in FIG. 7*b*. The items move through the deposit aperture 700 and are guided by guide surfaces 710, 711 which are spaced apart to receive any incoming items. The surfaces guide deposited items of media and are tapered from a relatively wide open mouth region at the deposit opening 700 towards the further input opening 701 in the cylinder. A user can urge the deposited items through the deposit opening 700 along the guide rails and through the further opening where the deposited items, whether cash and/or checks and/or other such media reach an acceptor grip roller pair 720. These provide a pinch point and are driven to rotate to thereafter draw incoming/deposited items of media along the feed slot formed between the guide surfaces and thereafter deposited items are transported to a further storage region within the terminal. Subsequent to a user depositing items and those items being taken into the terminal, the cylindrical body can be rotated still further in a clockwise direction into the position shown by FIG. 7*c* which is the "home" position again. Thereafter, the terminal is ready for a further user to make a deposit or request dispensation of an item of media. It will be appreciated that the drum can continue to rotate, collect a receipt, present this to a customer and purge if necessary and then return to home.

Certain embodiments of the present invention thus utilize a rotatable cylindrical drum which contains media collecting plates within it. The drum's home position is with a delivery aperture open in front of a spray dispenser throat. Notes are fed into the drum one-by-one from the dispenser onto the collecting plates. A stepper motor rotates the drum in a predetermined direction, for example, clockwise, to a second position where a second media type (such as a printed receipt or the like) can optionally be collected. The drum then continues to rotate towards a customer media exit. As the drum is rotated to this position, the media collecting plates close and clamp any items of media therebetween. This helps retain the collected items in a neat bunch. As the drum approaches the position at the customer media exit, the collecting plates project the notes forward whilst rotating, thus presenting a neat bunch to a customer. If the media items are not collected, for example, after a pre-determined period of time, the drum continues to rotate, retracting the bunch as it rotates and thereafter releasing the clamping plates at a desired position. For example, release can be timed to occur when vertically aligned. Non-collected items of media will thus drop into a purge bin located therebelow and within a safe of the terminal.

Certain embodiments of the present invention can accommodate media deposit solutions as well as media dispensing solutions. Alternatively, certain embodiments accommodate just deposit or just dispensing solutions. In respect of terminals including a deposit solution, the drum can rotate from a home position to expose a media acceptor slot where media such as cash or checks can be deposited by a user of the terminal. Thereafter, the drum continues to rotate, optionally collecting a receipt, presenting the receipt to the customer, passing a purge region and thereafter completing the cycle at a home position where deposited items are input into a safe region of the terminal. Such an option has the advantage of not requiring a separate deposit position.

Certain prior art solutions use expensive bunch dispensers with transport and media exit shutters. The cash shutter is vulnerable to attack by leveraging at its edge and inserting devices into the transport parts for various forms of attack. By contrast, certain embodiments of the present invention, being cylindrical, isolate the mechanics of the media sorting and dispenser from leverage and insertion of objects. In fact, movement of the drum and clamping plate helps dislodge and eject any attached unauthorized object as rotation occurs.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A Self-Service Terminal (SST), comprising:

a fascia panel comprising a panel portion having a circular arc-shaped cross-section and at least one panel aperture; and at least one media transfer device comprising an outer body portion having a circular arc-shaped cross-section, proximate to and spaced apart from the panel portion, and at least one body aperture; wherein the body portion is rotatable with respect to the curved panel portion to selectively reveal the body aperture through the panel aperture; and wherein the media transfer device comprises a drum element comprising a substantially hollow cylindrical body closed at a first and further end thereof and rotatable about a respective longitudinal axis of rotation, said outer body portion comprising a region of the outer surface of the cylindrical body, the outer body portion comprises at least two further body apertures and at least item support surface wherein the two further body apertures are aligned when the drum element is at a still further rotation position to thereby provide an item pathway from said panel aperture to a pair of opposed grip rollers of the SST.

2. The SST as claimed in claim 1, further comprising:

the media transfer device comprises a card reader housing supporting a user card reader device, and a front panel secured to the housing comprising said outer body portion, said housing being rotatable about a respective axis of rotation to rotate the outer body portion therewith.

3. The SST as claimed in claim 1, further comprising:

the panel portion and said body portion are manufactured from a tamper resistant material, wherein when the body aperture of the media transfer device is not aligned with the panel aperture, a remainder region of the outer body portion closes the panel aperture to unauthorized access.

4. The SST as claimed in claim 1, further comprising:

when the at least one media transfer device comprises a plurality of media transfer devices, each media transfer device is arranged to rotate together and/or separately about a common axis of rotation, said common axis comprising a centre of an imaginary circle including the circular arc of each respective body portion.

5. The SST as claimed in claim 1, further comprising:

the transfer device further comprises a pair of opposed clamping elements supported in the cylindrical body that move apart and close together as the drum element is rotated to receive items of media therebetween when apart at at least one rotation position and present items of media from therebetween when apart and aligned with said panel aperture at a further rotation position.

6. The SST as claimed in claim 5, further comprising:

the opposed clamping elements are locatable together towards said panel aperture when the drum element is at said further rotation position.

7. The SST as claimed in claim 5, further comprising:

the opposed clamping elements comprise a pair of clamp plates that are secured together at respective first ends thereof and open and close at respective further ends thereof automatically as the drum member rotates.

8. The SST as claimed in claim 1, wherein the SST is an Automated Teller Machine (ATM) and each item of media comprises a currency note.

* * * * *